US007464933B2

(12) United States Patent
Peters et al.

(10) Patent No.: US 7,464,933 B2
(45) Date of Patent: Dec. 16, 2008

(54) SINGLE WINNER BINGO GAME

(75) Inventors: Darin L. Peters, Dallas, TX (US); Larry Segebarth, Omaha, NE (US)

(73) Assignee: Distinctive Principles, L.L.C., Dallas, TX (US)

( * ) Notice: Subject to any disclaimer, the term of this patent is extended or adjusted under 35 U.S.C. 154(b) by 368 days.

(21) Appl. No.: 11/323,544

(22) Filed: Dec. 30, 2005

(65) Prior Publication Data

US 2007/0152401 A1 Jul. 5, 2007

(51) Int. Cl.
*A63F 3/06* (2006.01)
*A63F 3/08* (2006.01)

(52) U.S. Cl. ..... 273/269; 273/139

(58) Field of Classification Search ..... 273/269, 273/139

See application file for complete search history.

(56) References Cited

U.S. PATENT DOCUMENTS 2,409,584 A * 10/1946 Peterman ..... 273/269
4,775,155 A * 10/1988 Lees ..... 273/139
4,832,341 A * 5/1989 Muller et al. ..... 463/17

* cited by examiner

*Primary Examiner*—Benjamin H Layno
(74) *Attorney, Agent, or Firm*—Steven W. Smith

(57) ABSTRACT

A 3-number bingo game adapted to ensures there can be only a single winner. The numbers from 1 to 75 are divided into fifteen groups of five numbers each. For each group, the unique 3-number combinations of the five numbers taken three at a time are determined and printed on game cards. A single winner is determined if the unique 3-number combination on a player's game card matches a winning set of three numbers randomly determined by the House.

19 Claims, 4 Drawing Sheets

| B | I | N | G | O |
|---|---|---|---|---|
| 1 | 16 | 31 | 46 | 61 |
| 2 | 17 | 32 | 47 | 62 |
| 3 | 18 | 33 | 48 | 63 |
| 4 | 19 | 34 | 49 | 64 |
| 5 | 20 | 35 | 50 | 65 |
| 6 | 21 | 36 | 51 | 66 |
| 7 | 22 | 37 | 52 | 67 |
| 8 | 23 | 38 | 53 | 68 |
| 9 | 24 | 39 | 54 | 69 |
| 10 | 25 | 40 | 55 | 70 |
| 11 | 26 | 41 | 56 | 71 |
| 12 | 27 | 42 | 57 | 72 |
| 13 | 28 | 43 | 58 | 73 |
| 14 | 29 | 44 | 59 | 74 |
| 15 | 30 | 45 | 60 | 75 |

FIG. 2A

| B | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|
| I | 16 | 17 | 18 | 19 | 20 | 21 | 22 | 23 | 24 | 25 | 26 | 27 | 28 | 29 | 30 |
| N | 31 | 32 | 33 | 34 | 35 | 36 | 37 | 38 | 39 | 40 | 41 | 42 | 43 | 44 | 45 |
| G | 46 | 47 | 48 | 49 | 50 | 51 | 52 | 53 | 54 | 55 | 56 | 57 | 58 | 59 | 60 |
| O | 61 | 62 | 63 | 64 | 65 | 66 | 67 | 68 | 69 | 70 | 71 | 72 | 73 | 74 | 75 |

FIG. 2B

SINGLE WINNER BINGO GAME

BACKGROUND OF THE INVENTION

1. Technical Field of the Invention

This invention relates to games of chance. More particularly, and not by way of limitation, the invention is directed to a game of chance such as 3-number bingo, and a method that guarantees a single unique winner.

2. Description of Related Art

Bingo is a game of chance played with a pool of numbers ranging from 1-75. There are many variations of the basic game of bingo, which is played on a square game-sheet having five rows and five columns forming 25 smaller squares. Each of the five columns is headed by one of the five letters in the word BINGO. The numbers 1-75 are divided into five groups of 15 numbers each, and each group of 15 numbers is associated with one of the letters in the word BINGO. In other words, the numbers 1-15 are associated with the letter 'B'; the numbers 16-30 are associated with the letter 'I'; the numbers 31-45 are associated with the letter 'N'; the numbers 46-60 are associated with the letter 'G'; and the numbers 61-75 are associated with the letter 'O'. On a player's game sheet, the five squares in each column are filled with five numbers randomly drawn from the 15 numbers associated with that column's letter. During the game, the house randomly draws numbers between 1 and 75, and players match the drawn numbers with numbers on their game sheet. The first player to match all of the numbers in any row, column, or diagonal of their game sheet is a winner. However, since the numbers on the game sheets are random, and the numbers drawn are also random, it is possible to have more than one simultaneous winner.

FIG. 1 is a flow chart illustrating the steps of another known version of playing bingo. In this version, rather than playing with a 25 square game sheet, players are provided with small cards similar to instant-win lottery tickets. When opened, each card is printed with three numbers in the range of 1-75. A player wins whenever the three numbers on the player's card have been called.

In the example shown in FIG. 1, it is assumed that 1,000 cards are distributed to players. This number, of course, may be more or less. At step 11, the House prints (or has a vendor print) a large number of cards with three random numbers in the range of 1-75. At step 12, the House distributes 1,000 cards to the players. At step 13, the house randomly calls numbers in the range of 1-75. Generally, the called numbers are displayed on a large flashboard visible to all players. The positioning of the called numbers on the flashboard has no significance to the game. The flashboard is merely utilized as an aid to remind players which numbers have been called.

The House continues to call random numbers, until one or more simultaneous winners are determined. At step 14, the House pays out winnings to the simultaneous winners, which may theoretically be anywhere in the range of 1-1,000 simultaneous winners.

It is often desirable from the perspective of the House and the players to have a single unique winner of a bingo game. If the House promised a particular prize to the winner, and there were several simultaneous winners, the House may have to pay out more than anticipated. On the other hand, if a fixed amount is available for the winner, and there are several winners, then the fixed amount must be split between the winners.

Prior art methods of playing bingo do not ensure a single unique winner of a bingo game. What is needed in the art is a bingo game and method that overcomes the shortcomings of prior art methods of playing bingo. The present invention provides such a bingo game and method.

SUMMARY OF THE INVENTION

The present invention is directed to a method of playing a game of chance between a plurality of players and a House, wherein each player has a game piece comprising a set of indicators, and a winner is determined if a player's set of indicators matches a winning set of indicators randomly determined by the House. The method ensures there can be only a single winner. The method includes determining by the House, a pool of possible indicators; dividing the pool of possible indicators into a predefined number of divisions; and for each division, calculating the number of unique combinations of the indicators in the division taken in groups equal in size to the number of indicators in each player's set of indicators. Each unique combination is then associated with one of a plurality of game pieces. The method also includes providing the plurality of game pieces to the players; randomly determining the winning set of indicators; and determining a single winner as the player having the game piece with the set of indicators that matches the winning set of indicators.

In another embodiment, the present invention is directed to a method of playing 3-number bingo between a plurality of players and a House, wherein each player has a game card with a set of three numbers between 1 and 75 printed thereon, and a winner is determined if a player's set of numbers matches a winning set of three numbers randomly determined by the House. Again, the method ensures there can be only a single winner. The method includes dividing the numbers from 1 to 75 into fifteen groups of five numbers each; calculating for each group of five numbers, the number of unique 3-number combinations of the five numbers taken three at a time; and printing each unique 3-number combination on one of a plurality of game cards. The plurality of game cards are then provided to the players. The method also includes randomly determining the winning set of numbers; and determining a single winner as the player having the game card with the unique 3-number combination that matches the winning set of numbers.

In another aspect, the present invention is directed to a 3-number bingo game played between a plurality of players and a House, wherein the game is adapted so that there can be only a single winner. The game includes a plurality of game cards, each game card having a unique 3-number combination of numbers between 1 and 75 printed thereon; and means for the House to determine a winning set of three numbers matching one of the unique 3-number combinations.

BRIEF DESCRIPTION OF THE DRAWINGS

A more complete understanding of the present invention may be had by reference to the following Detailed Description when taken in conjunction with the accompanying drawings wherein:

FIGS. 2A and 2B are flashboards suitable for use with the bingo game of the present invention;

DETAILED DESCRIPTION OF EXEMPLARY EMBODIMENTS

In one embodiment, the present invention is a 3-number bingo game and method of playing the game that ensures that there is only one winner. Each card eligible to play the game is printed with a unique 3-number combination. Therefore, the first player to match all three numbers on his card must be the only winner.

FIGS. 2A and 2B are flashboards suitable for use with the bingo game of the present invention. FIG. 2A illustrates a vertically oriented flashboard, and FIG. 2B illustrates a horizontally oriented flashboard. In the vertical orientation of FIG. 2A, there are five columns; each headed by one of the letters of the word BINGO, and each containing 15 sequential numbers. In the vertical orientation, each row contains five numbers, one from each of the five columns. In the horizontal orientation of FIG. 2B, there are five rows, each headed by one of the letters of the word BINGO, and each containing 15 sequential numbers. In the horizontal orientation, each column contains five numbers, one from each of the five rows.

Figure 1:
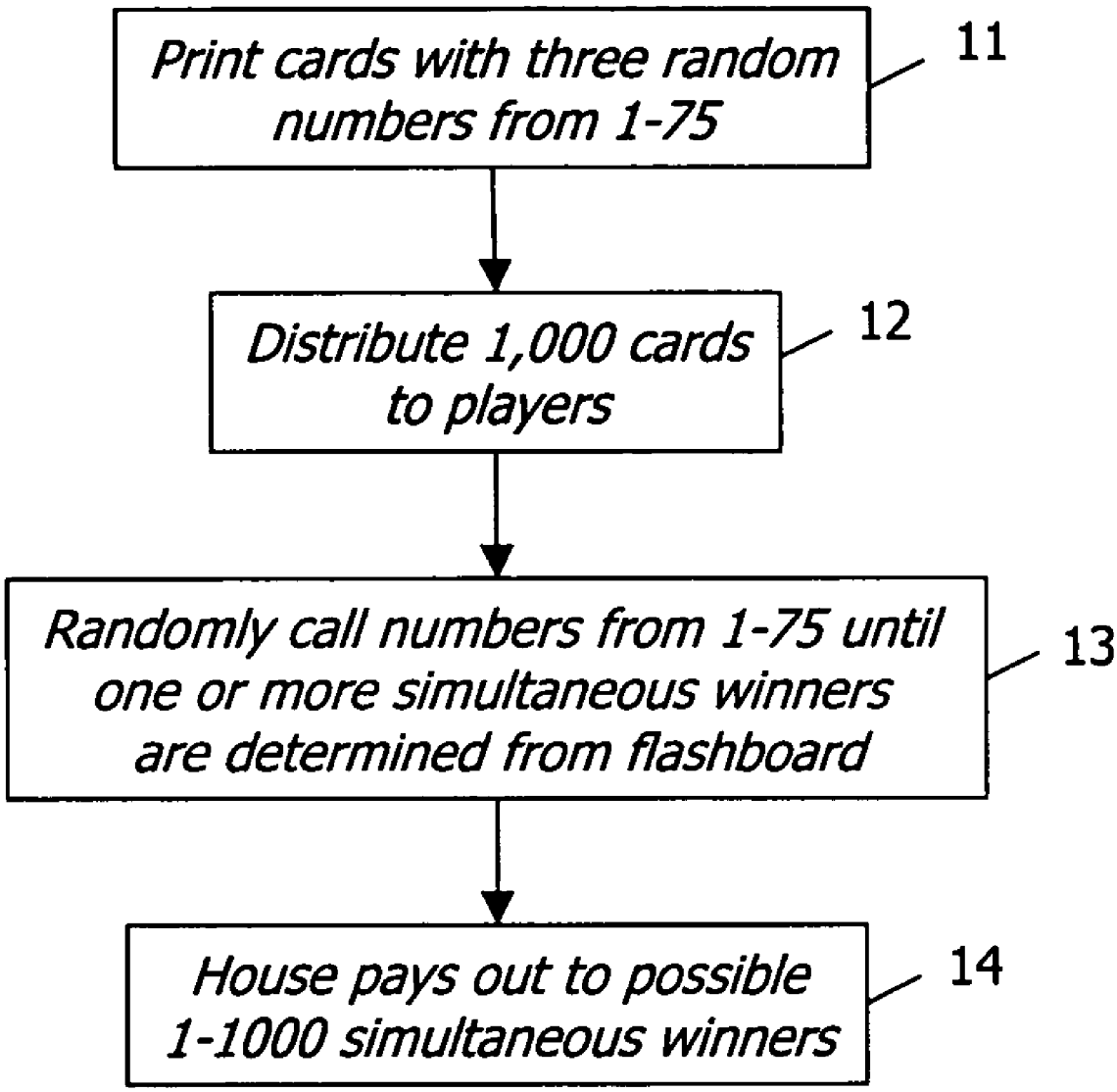
FIG. 1 (PRIOR ART)
FIG. 1 (Prior Art) is a flow chart illustrating the steps of a known method of playing bingo.
Figure 3:
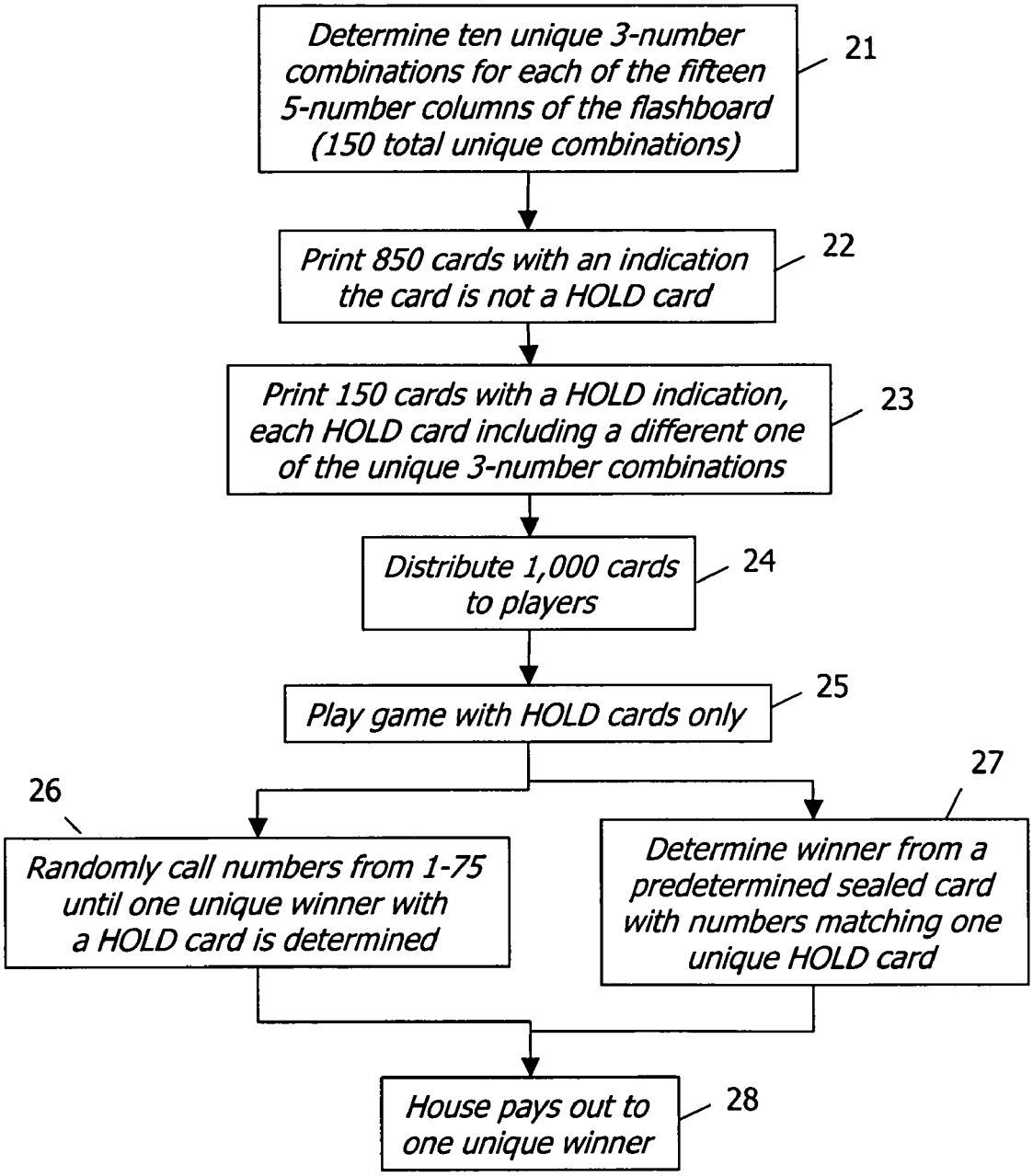
FIG. 3 is a flow chart illustrating the steps of an embodiment of a method of playing bingo in accordance with the teachings of the present invention.

FIG. 3 is a flow chart illustrating the steps of an embodiment of a method of playing bingo in accordance with the teachings of the present invention. At step 21, ten unique 3-number combinations are determined for each of the fifteen 5-number columns of the flashboard (assuming a horizontally oriented flashboard as shown in FIG. 2B). It can be shown mathematically that any set of five different numbers can be combined three at a time to form ten unique combinations. Mathematically, this is shown as follows:

$$\begin{aligned} {}^{5}C_3 &= 5!/(5-3)!\cdot 3! \\ &= 120/(2\cdot 6) \\ &= 120/12 \\ &= 10 \end{aligned}$$

Since the Dashboard has fifteen 5-number columns, there are a total of 150 unique 3-number combinations, when combinations are formed one column at a time. Assuming once again that 1,000 cards are to be distributed to players, 850 cards are printed at step 22 with an indication that the card is not a HOLD card (or alternatively, these cards are printed without an indication that the card is a HOLD card). At step 23, 150 cards are printed with a HOLD indication. Each HOLD card includes a different one of the 150 unique 3-number combinations. At step 24, the House distributes the 1,000 cards to the players. At step 25, the bingo game is played with the HOLD cards only.

A winner may be determined in alternative ways. At step 26, the House randomly calls numbers from in the range of 1-75, until one unique winner with a HOLD card is determined. Since each of the 150 3-number combinations on the HOLD cards is unique, there can be only one winner. Additionally, when combinations are formed one column at a time as described above, the House can quickly determine that there has been a winner whenever three numbers in any one column have been drawn. This is because each 3-number combination has been uniquely assigned to a single HOLD card.

In an alternative embodiment, a winner may be determined at step 27 by opening a predetermined sealed card matching one of the 150 unique 3-number combinations on the HOLD cards. Once again, there can be only one winner. From step 26 or 27, the method proceeds to step 28, where the House pays out to the one unique winner.

In the embodiment shown and described above, each HOLD card has a 1 in 150 chance of being a winner. The odds may be changed in other embodiments by computing different combinations and printing a set of HOLD cards reflecting the new combinations. For example, still referring to FIG. 2B, combinations may be computed for the number of combinations of the 15 numbers in each row taken three at a time. Mathematically, this is shown as follows:

$$\begin{aligned} {}^{15}C_3 &= 15!/(15-3)!\cdot 3! \\ &= (15\cdot 14\cdot 13)/6 \\ &= 2{,}730/6 \\ &= 455 \end{aligned}$$

Thus, there are 455 unique 3-number combinations in each row of the flashboard illustrated in FIG. 2B. Since the flashboard has five 15-number rows, there are a total of 455×5=2,275 unique 3-number combinations, when combinations are formed one row at a time. Thus in this embodiment, each HOLD card has a 1 in 2,275 chance of being a winner.

Other combinations of the numbers on the flashboard may also be utilized to achieve different odds of winning. At one extreme, if combinations are computed for all 75 numbers on the flashboard taken three at a time, it is found that there are 67,525 unique 3-number combinations. In such an embodiment, each HOLD card has a 1 in 67,525 chance of being a winner.

In another exemplary embodiment, intermediate odds of winning may be achieved by computing combinations on a per column basis for a predefined number of columns, and then computing combinations for the remaining partial rows. For example, combinations may be computed for the first eight 5-number columns in the manner shown in the first embodiment above. This calculation results in a total of 80 unique 3-number combinations. Combinations may then be calculated on a row-by-row basis for the remaining seven positions. For each partial row (i.e., positions nine through 15), there are 35 combinations of the seven numbers taken three at a time. Since there are five such partial rows, there are an additional 175 unique 3-number combinations. Thus, the total number of unique combinations in this embodiment is 80+175=255. If a hold card is printed for each unique 3-number combination, each HOLD card has a 1 in 255 chance of being a winner.

In each embodiment, since each HOLD card includes a unique 3-number combination, there can be only one winner.

Figure 4:
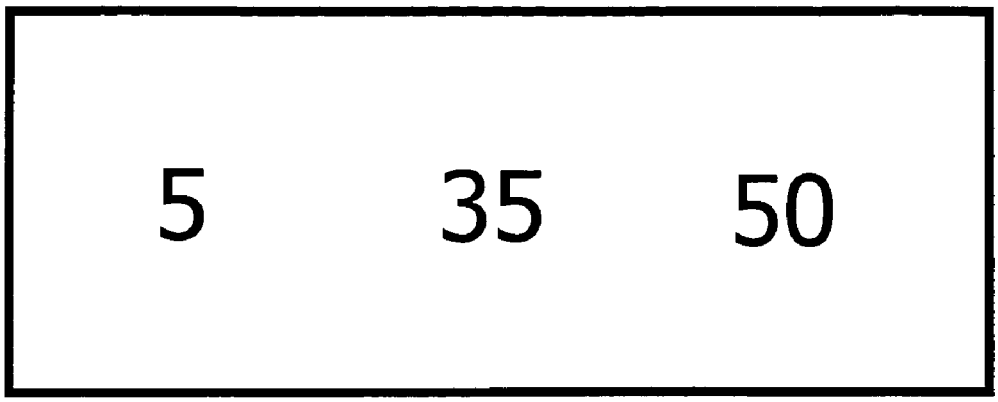
FIG. 4 is a game card with a set of three numbers between 1 and 75 printed thereon.

FIG. 4 is a game card with a set of three numbers between 1 and 75 printed thereon.

Figure 5:
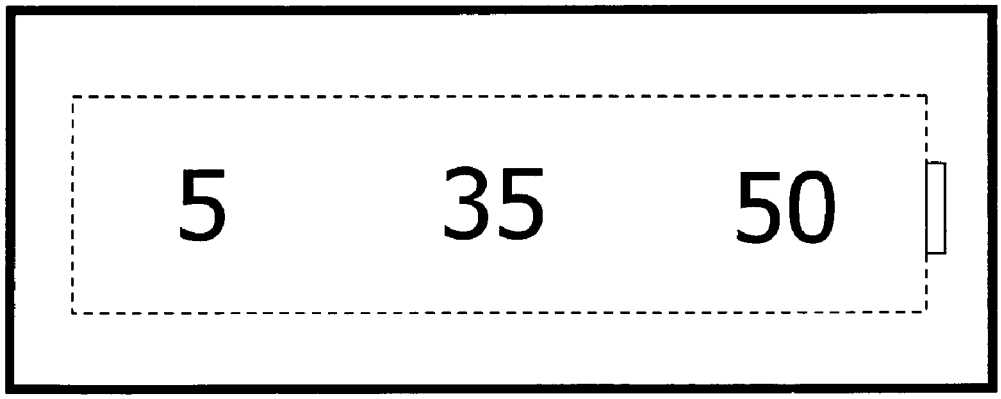
FIG. 5 is a sealed card for use by the House that contains the winning 3-number combination.

FIG. 5 is a sealed card for use by the House that contains the winning 3-number combination.

As will be recognized by those skilled in the art, the innovative concepts described in the present application can be modified and varied over a wide range of applications. For example, the pool of numbers being played may be greater or lesser than 75, and the HOLD cards may include greater or lesser than three numbers. The invention may also be utilized with indicators other than numbers such as letters or other symbols. Accordingly, the scope of patented subject matter should not be limited to any of the specific exemplary teachings discussed above, but is instead defined by the following claims.

What is claimed is:

1. A method of playing a game of chance between a plurality of players and a House, wherein each player has a game piece comprising a set of indicators, and a winner is determined if a player's set of indicators matches a winning set of indicators randomly determined by the House, wherein the method ensures there can be only a single winner, said method comprising:

determining by the House, a pool of possible indicators;

dividing the pool of possible indicators into a predefined number of divisions;

for each division, calculating the number of unique combinations of the indicators in the division taken in groups equal in size to the number of indicators in each player's set of indicators;

associating each unique combination with one of a plurality of game pieces;

providing the plurality of game pieces to the players, the number of game pieces being equal to the number of unique combinations of indicators;

randomly selecting indicators from the pool of possible indicators until all of the indicators in a first unique combination have been selected; and determining a single winner as the player having the one and only one game piece associated with the first unique combination.

2. The method according to claim 1, wherein the step of determining a pool of possible indicators includes determining that the game will be played with numbers ranging from 1 to 75.

3. The method according to claim 2, wherein the step of dividing the pool of possible indicators into a predefined number of divisions includes dividing the 75 numbers into fifteen groups of five numbers each.

4. The method according to claim 3, wherein each game piece comprises a set of three numbers, and the step of calculating the number of unique combinations includes calculating for each group of five numbers, the number of unique 3-number combinations of the five numbers in the group.

5. The method according to claim 4, wherein the step of associating each unique combination with one of a plurality of game pieces includes printing each unique 3-number combination on a game card.

6. The method according to claim 5, wherein the step of randomly selecting indicators from the pool of possible indicators includes randomly drawing numbers one at a time in the range from 1 to 75 until three numbers on a single player's game piece have been drawn.

7. The method according to claim 5, wherein the step of randomly selecting indicators from the pool of possible indicators includes opening a sealed card by the House that contains a randomly selected 3-number combination.

8. The method according to claim 2, wherein the step of dividing the pool of possible indicators into a predefined number of divisions includes dividing the 75 numbers into five groups of fifteen numbers each.

9. The method according to claim 8, wherein each game piece comprises a set of three numbers, and the step of calculating the number of unique combinations includes calculating for each group of fifteen numbers, the number of unique 3-number combinations of the fifteen numbers in the group.

10. A method of playing 3-number bingo between a plurality of players and a House, wherein each player has a game card with a set of three numbers between 1 and 75 printed thereon, and a winner is determined if a player's set of numbers matches a winning set of three numbers randomly determined by the House, wherein the method ensures there can be only a single winner, said method comprising:

dividing the numbers from 1 to 75 into fifteen groups of five numbers each;

calculating for each group of five numbers, the number of unique 3-number combinations of the five numbers in the group;

printing each unique 3-number combination on one of a plurality of game cards;

providing the plurality of game cards to the players the number of game cards being equal to the number of unique 3-number combinations;

randomly determining the winning set of three numbers by the House; and determining the single winner as the player having the one and only one game card with the unique 3-number combination that matches the winning set of three numbers.

11. The method according to claim 10, wherein the step of randomly determining the winning set of numbers includes randomly drawing numbers one at a time in the range from 1 to 75 until three numbers on a single player's game card have been drawn.

12. The method according to claim 10, wherein the step of randomly determining the winning set of numbers includes opening a sealed card by the House that contains the winning 3-number combination.

13. A game of chance played between a plurality of players and a House, wherein a winner is determined by matching a combination of indicators associated with a game piece with a winning combination of indicators determined by the House, wherein the game is adapted so that there can be only a single winner, said game comprising:

means for calculating, for combinations of a given number of indicators, the number of unique combinations of indicators of the given size from a larger pool of indicators of a predetermined size;

a plurality of game pieces equal to the number of unique combinations of indicators, each game piece having one of the unique combinations of indicators associated therewith, and all of the game pieces being distributed to the plurality of players; and means for the House to determine a winning combination of indicators matching one and only one of the unique combinations associated with one and only one of the game pieces.

14. The game of chance according to claim 13, wherein the means for calculating the number of unique combinations includes:

means for dividing the numbers from 1 to 75 into five groups of fifteen numbers each; and means for calculating for each group of fifteen numbers, the number of unique 3-number combinations of the fifteen numbers in the group.

15. The game of chance according to claim 13, wherein the means for calculating the number of unique combinations includes:

means for dividing the numbers from 1 to 75 into fifteen groups of five numbers each; and means for calculating for each group of five numbers, the number of unique 3-number combinations of the five numbers in the group.

16. The game of chance according to claim 15, wherein the means for dividing the numbers from 1 to 75 into fifteen groups of five numbers each includes means for dividing the numbers in a manner equivalent to a bingo flashboard.

17. The game of chance according to claim 16, wherein the means for the House to determine a winning combination of indicators includes a sealed card opened by the House that contains the winning 3-number combination.

18. The game of chance according to claim 16, wherein the means for the House to determine a winning combination of indicators includes means for randomly drawing numbers one at a time in the range from 1 to 75 until three numbers associated with a single player's game piece have been drawn.

19. The game of chance according to claim 18, wherein the means for the House to determine a winning combination of indicators includes a bingo flashboard adapted to indicate each number that has been drawn, wherein a winner is indicated whenever three numbers have been drawn in any one column.

* * * * *